US011874071B2

(12) United States Patent
Romlund

(10) Patent No.: US 11,874,071 B2
(45) Date of Patent: Jan. 16, 2024

(54) HEAT EXCHANGER PLATE, A PLATE HEAT EXCHANGER, AND A METHOD OF MAKING A PLATE HEAT EXCHANGER

(71) Applicant: ALFA LAVAL CORPORATE AB, Lund (SE)

(72) Inventor: Jens Romlund, Helsingborg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 735 days.

(21) Appl. No.: 16/083,546

(22) PCT Filed: Mar. 13, 2017

(86) PCT No.: PCT/EP2017/055803
§ 371 (c)(1),
(2) Date: Sep. 10, 2018

(87) PCT Pub. No.: WO2017/174301
PCT Pub. Date: Oct. 12, 2017

(65) Prior Publication Data

US 2019/0033005 A1 Jan. 31, 2019

(30) Foreign Application Priority Data

Apr. 6, 2016 (SE) ..... 1650468-0

(51) Int. Cl.
*F28D 9/00* (2006.01)
*B21D 53/04* (2006.01)
(Continued)

(52) U.S. Cl.
CPC ..... *F28D 9/005* (2013.01); *B21D 53/04* (2013.01); *C22C 19/055* (2013.01);
(Continued)

(58) Field of Classification Search
CPC .... F28F 3/005; F28F 3/08; F28F 3/083; F28F 3/10; F28F 9/026; F28F 9/0278; F28D 9/00; F28D 9/0081; F25B 39/022
See application file for complete search history.

(56) References Cited

U.S. PATENT DOCUMENTS 4,402,362 A * 9/1983 Dubrovsky ..... F28D 9/0062 165/166
7,363,797 B2 * 4/2008 Kawasaki ..... B21D 13/08 72/361
(Continued)

FOREIGN PATENT DOCUMENTS

CN 102829655 A 12/2012
CN 104755873 A 7/2015
(Continued)

OTHER PUBLICATIONS

CN-102829655-A English Machine translation (Year: 2012).*
(Continued)

*Primary Examiner* — Jianying C Atkisson
*Assistant Examiner* — For K Ling
(74) *Attorney, Agent, or Firm* — BUCHANAN INGERSOLL & ROONEY PC

(57) ABSTRACT

A heat exchanger plate, a plate heat exchanger for evaporation of a first fluid, and a method of making a plate heat exchanger are disclosed. The heat exchanger plate includes a heat exchanger area extending in parallel with an extension plane of the heat exchanger plate, an edge area extending around the heat exchanger area, a number of portholes extending through the heat exchanger area, and a peripheral rim surrounding a first porthole of the number of portholes and extending transversely to the extension plane from a root end to a top end with a rim height perpendicular to the extension plane. The heat exchanger plate includes at least
(Continued)

one restriction hole extending through the peripheral rim and having a hole height perpendicular to the extension plane.

15 Claims, 4 Drawing Sheets

(51) Int. Cl.

| | |
|---|---|
| ***F28F 9/02*** | (2006.01) |
| ***F28F 3/10*** | (2006.01) |
| ***F28D 21/00*** | (2006.01) |
| ***C22C 19/05*** | (2006.01) |

(52) U.S. Cl.
CPC ..... *C22C 19/056* (2013.01); *F28D 9/0037* (2013.01); *F28F 3/10* (2013.01); *F28F 9/026* (2013.01); *F28D 2021/0064* (2013.01); *F28F 2225/00* (2013.01); *F28F 2275/04* (2013.01)

(56) References Cited

U.S. PATENT DOCUMENTS

| | | | | |
|---|---|---|---|---|
| 7,618,598 | B2 | 11/2009 | Reinke et al. | |
| 2002/0174978 | A1* | 11/2002 | Beddome | F28D 9/0043 165/174 |
| 2005/0194123 | A1 | 9/2005 | Strahle et al. | |
| 2006/0032251 | A1* | 2/2006 | Wakita | B23P 15/26 62/165 |
| 2007/0169916 | A1 | 7/2007 | Wand et al. | |
| 2008/0053137 | A1* | 3/2008 | Higashiyama | B60H 1/00335 62/324.6 |
| 2011/0308779 | A1 | 12/2011 | Andersson et al. | |
| 2015/0292803 | A1* | 10/2015 | Nyander | F28F 3/10 165/166 |

FOREIGN PATENT DOCUMENTS

| | | | |
|---|---|---|---|
| EP | 2508832 | A1 | 10/2012 |
| EP | 2730870 | A2 | 5/2014 |
| EP | 2730878 | A1 | 5/2014 |
| GB | 134277 | A | 10/1919 |
| JP | 2001099587 | A | 4/2001 |
| JP | 2012-512379 | A | 5/2012 |
| JP | 2016-502059 | A1 | 1/2016 |
| SE | 8702608 | | 12/1988 |
| WO | 2006110090 | A1 | 10/2006 |
| WO | 2010069872 | A1 | 6/2010 |

OTHER PUBLICATIONS

International Search Report (PCT/ISA/210) dated May 23, 2017, by the European Patent Office as the International Searching Authority for International Application No. PCT/EP2017/055803.
Written Opinion (PCT/ISA/237) dated May 23, 2017, by the European Patent Office as the International Searching Authority for International Application No. PCT/EP2017/055803.
Office Action (Notice of Reasons for Rejection) dated Oct. 21, 2019, by the Japanese Patent Office in corresponding Japanese Patent Application No. 2018-552878 and an English Translation of the Office Action. (13 pages).

* cited by examiner

HEAT EXCHANGER PLATE, A PLATE HEAT EXCHANGER, AND A METHOD OF MAKING A PLATE HEAT EXCHANGER

TECHNICAL FIELD OF THE INVENTION

The present invention refers to a heat exchanger plate to be comprised by a plate heat exchanger configured for evaporation of a first fluid, the heat exchanger plate comprising a heat exchanger area extending in parallel with an extension plane of the heat exchanger plate, an edge area extending around the heat exchanger area, a number of portholes extending through the heat exchanger area, and a peripheral rim surrounding a first porthole of said number of portholes and extending transversely to the extension plane from a root end to a top end with a rim height perpendicular to the extension plane.

The present invention also refers to a plate heat exchanger for evaporation, comprising first heat exchanger plates and second heat exchanger plates, which form first plate interspaces for a first fluid to be evaporated and second plate interspaces for a second fluid, wherein each of the first heat exchanger plates and the second heat exchanger plates extends in parallel with an extension plane and comprises a heat exchanger area extending in parallel with an extension plane of the heat exchanger plate, an edge area extending around the heat exchanger area, and a number of portholes extending through the heat exchanger area, wherein each of the first heat exchanger plates comprises a peripheral rim surrounding a first porthole of said number of portholes and extending transversely to the extension plane from a root end to a top end with a rim height perpendicular to the extension plane, wherein each of the first heat exchanger plates comprises at least one restriction hole extending through the peripheral rim and having a hole height perpendicular to the extension plane, wherein the first heat exchanger plates and the second heat exchanger plates are joined to each other via joints of braze material between the first and second heat exchanger plates and arranged in such a way that the peripheral rims define an inlet channel extending through the plate heat exchanger, and wherein the at least one restriction hole forms a fluid passage for the first fluid from the inlet channel to the first plate interspaces.

Moreover, the present invention refers to a method of making a plate heat exchanger configured for evaporation, comprising first heat exchanger plates and second heat exchanger plates, wherein each of the first and second heat exchanger plates has a number of portholes and wherein a first porthole of said number of portholes of the first heat exchanger plates is surrounded by a peripheral rim.

BACKGROUND OF THE INVENTION, AND PRIOR ART

EP-2 730 870 discloses a plate package and a method of making a plate package. The plate package comprises a number of first heat exchanger plates and a number of second heat exchanger plates, which are arranged side by side in such a way that a first plate interspace is formed between each pair of adjacent first heat exchanger plates and second heat exchanger plates, and a second plate interspace between each pair of adjacent second heat exchanger plates and first heat exchanger plates. The first plate interspaces and the second plate interspaces are separated from each other and provided side by side in an alternating order in the plate package. Each of the first and second heat exchanger plates has a first porthole, surrounded by a peripheral rim.

The first heat exchanger plates and the second heat exchanger plates are joined to each other via joints of braze material between the first and second heat exchanger plates and arranged in such a way that the peripheral rims together define an inlet channel extending through the plate package. After the brazing has been made, at least one restriction hole is made through the peripheral rim of the first and/or the second heat exchanger plates. The restriction hole forms a fluid passage allowing a communication between the inlet channel and the first plate interspaces.

A problem with the plate package disclosed in EP-2 730 878 is the difficulty to make the restriction hole in the rim. The hole-making tool, comprising a laser beam head, an electron beam head or a plasma head, has to be introduced into the inlet channel. This is complicated and time consuming because of the limited space available in the inlet channel for receiving the hole-making tool.

SUMMARY OF THE INVENTION

The object of the invention is to overcome the problem discussed above. In particular, it is aimed at heat exchanger plate and a plate heat exchanger, which permit a more efficient and rapid manufacturing. It is also aimed at a more efficient and rapid manufacturing method.

The object is achieved by the heat exchanger plate initially defined, which is characterized in that the heat exchanger plate comprises at least one restriction hole extending through the peripheral rim and having a hole height perpendicular to the extension plane.

Such a heat exchanger plate is suitable for being used in a plate heat exchanger and joined to other heat exchanger plate through brazing. The inventor has realized that the restriction hole may be kept open during the brazing and after the brazing has been performed by positioning the restriction hole at the peripheral rim so that capillary forces acting on the braze material during the brazing will draw the brazing material away from the restriction hole.

At the root end and the top end, the peripheral rim of the heat exchanger plate may form overlap joints with adjacent heat exchanger plates in the plate heat exchanger. These joints may due to capillary forces attract the braze material during the brazing, and thus draw the brazing material away from the restriction hole.

According to an embodiment of the invention, the peripheral rim tapers towards the top end, especially from the root end to the top end.

According to an embodiment of the invention, the at least one restriction hole is centrally located between the root end and the top end of the peripheral rim.

By locating the restriction hole centrally between the root end and the top end, the restriction hole will be located at a maximum distance from the joints.

According to an embodiment of the invention, the root end of the peripheral rim forms an annular transition portion between the peripheral rim and the heat exchanger area. The annular transition portion may due to capillary forces attract the braze material during the brazing, and thus draw the brazing material away from the restriction hole.

The top end may be formed by a top edge turned away from the root end.

According to an embodiment of the invention, the relation h/H is at most 30%, i.e. the height of the restriction hole is at most 30% of the height of the peripheral rim. This maximum hole height of the restriction hole contributes to create a suitable pressure drop of the first fluid when entering the first plate interspace.

Preferably, the relation h/H is at most 25%, more preferably at most 20% and most preferably at most 15%.

According to an embodiment of the invention, the hole height of the at least one restriction hole is equal to or smaller than 3 mm, preferably equal to or smaller than 2 mm, and more preferably equal to or smaller than 1 mm.

According to an embodiment of the invention, the hole height of the restriction hole is at least 0.3 mm.

According to an embodiment of the invention, the heat exchanger plate is made of a metal or a metal alloy extending to the outer surface of the heat exchanger plate. The outer surface of the metal or metal alloy may have such properties that it adheres to a braze material.

According to an embodiment of the invention, the peripheral rim forms an annular transition portion to the heat exchanger area, wherein the annular transition portion is concavely curved with a radius of curvature being at most 1 mm. Such a relatively small radius of curvature at the root end, i.e. at the annular transition portion to the heat exchanger area, may due to capillary forces attract the braze material during the brazing.

According to an embodiment of the invention, the peripheral rim has a convex side, and an opposite concave side, wherein annular transition portion is formed by a concavely curved transition of the convex side to the heat exchanger area.

According to an embodiment of the invention, the heat exchanger plate has a thickness, wherein the peripheral rim forms a transition portion to the heat exchanger area, and wherein the transition portion is concavely curved with a radius of curvature which is equal to or less than 3 times the thickness.

Preferably, the radius of curvature is at most 1 mm, more preferably at most 0.7 mm, still more preferably at most 0.5 mm, and most preferably at most 0.3 mm.

According to an embodiment of the invention, the radius of curvature is at least 0.2 mm.

The object is also achieved by the plate heat exchanger initially defined, which is characterized in that the at least one restriction hole is premade before the first heat exchanger plates and the second heat exchanger plates are assembled and joined to each other to form the plate heat exchanger.

As mentioned above, the inventor has realized that the premade restriction holes may be kept open during the brazing and after the brazing has been performed by positioning the restriction hole at the peripheral rim so that capillary forces acting on the braze material during the brazing will draw the brazing material away from the restriction hole.

According to an embodiment of the invention, the at least one restriction hole is so located between the root end and the top end of the rim to prevent the braze material from reaching the restriction hole when the heat exchanger plates are joined to each other. Thus, the capillary forces, acting on the braze material during the brazing, may draw the brazing material away from the restriction hole.

According to an embodiment of the invention, the peripheral rim tapers towards the top end, especially from the root end to the top end.

According to an embodiment of the invention, the at least one restriction hole is centrally located between the root end and the top end of the peripheral rim.

According to an embodiment of the invention, the relation h/H is at most 30%, preferably at most 25%, more preferably at most 20% and most preferably at most 15%.

According to an embodiment of the invention, the hole height of the at least one restriction hole is equal to or smaller than 3 mm, preferably equal to or smaller than 2 mm, and more preferably equal to or smaller than 1 mm.

According to an embodiment of the invention, each of the first heat exchanger plates has a thickness, wherein the peripheral rim forms a transition portion to the heat exchanger area, and wherein the transition portion is concavely curved with a radius of curvature which is equal to or less than 3 times the thickness.

Preferably, the radius of curvature is at most 1 mm, more preferably at most 0.7 mm, still more preferably at most 0.5 mm, and most preferably at most 0.3 mm.

According to an embodiment of the invention, the radius of curvature is at least 0.2 mm.

According to an embodiment of the invention, the top end of the peripheral rim of one of the first heat exchanger plates and the root end of the peripheral rim of an adjacent first heat exchanger plate overlap each other and form an overlap joint. The overlap joint may, due to capillary forces, attract brazing material from the restriction hole during the brazing of the plate heat exchanger, and thus draw the brazing material away from the restriction hole. The top end of the peripheral rim of one of the first heat exchanger plates may have a convex side that adjoin a concave side of the root end of the peripheral rim of the adjacent first heat exchanger plate.

The object is also achieved by the method initially defined, which comprises the steps of:

- bending the peripheral rim to extend transversely to the extension plane from a root end to a top end with a rim height perpendicular to the extension plane,
- making at least one restriction hole through peripheral rim before or after the bending of the peripheral rim,
- thereafter arranging the first and second heat exchanger plates side by side with braze material therebetween to permit the formation of a first plate interspace for a first fluid to be evaporated and a second plate interspace for a second fluid, and
- heating the first heat exchanger plates, the second heat exchanger plates and the braze material to join the heat exchanger plates to each other via joints of braze material between the first and second heat exchanger plates, wherein the peripheral rims together define an inlet channel extending through the plate heat exchanger, and the at least one restriction hole forms a fluid passage for the first fluid from the inlet channel to the first plate interspaces.

The method is suitable for manufacturing the plate heat exchanger defined above.

According to a further embodiment of the invention, the arranging step comprises arranging the first and second heat exchanger plates so that the top end of the peripheral rim of one of the first heat exchanger plates is introduced into the root end of the peripheral rim of an adjacent first heat exchanger plate to permit formation of an overlap joint.

BRIEF DESCRIPTION OF THE DRAWINGS

The present invention is now to be explained more closely through a description of various embodiments and with reference to the drawings attached hereto.

DETAILED DESCRIPTION OF VARIOUS EMBODIMENTS

Figure 1:
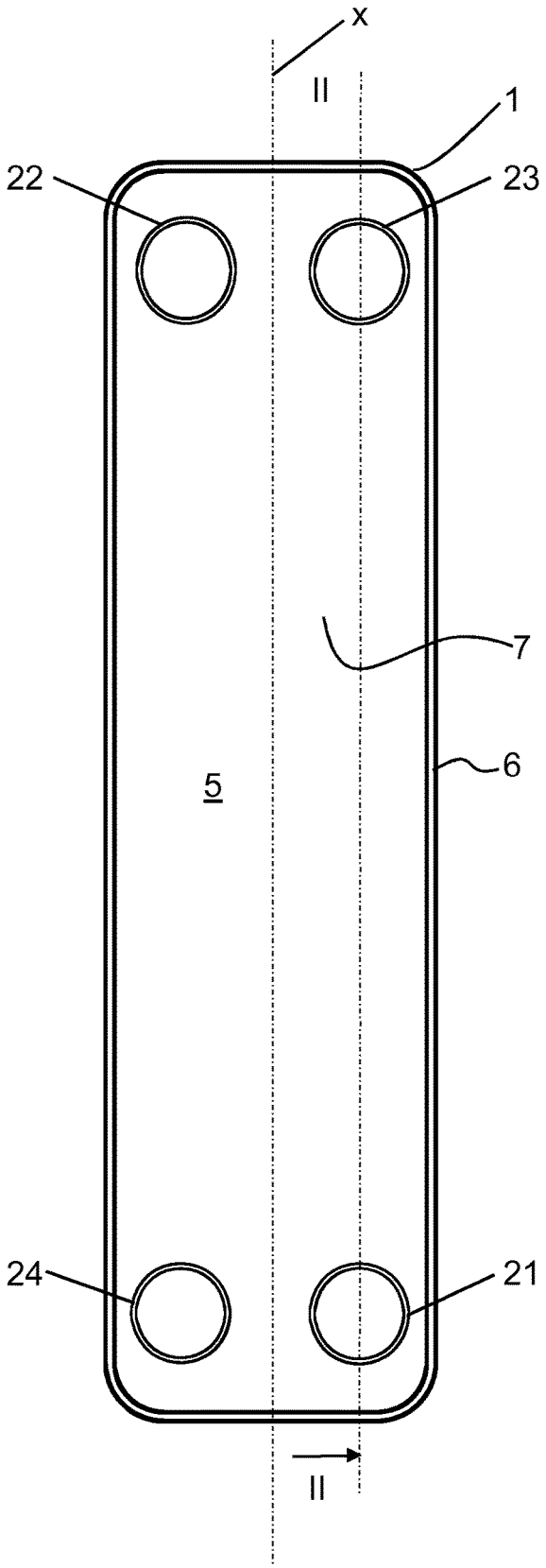
FIG. 1 discloses schematically a plan view of a plate heat exchanger according to a first embodiment of the invention.
Figure 2:
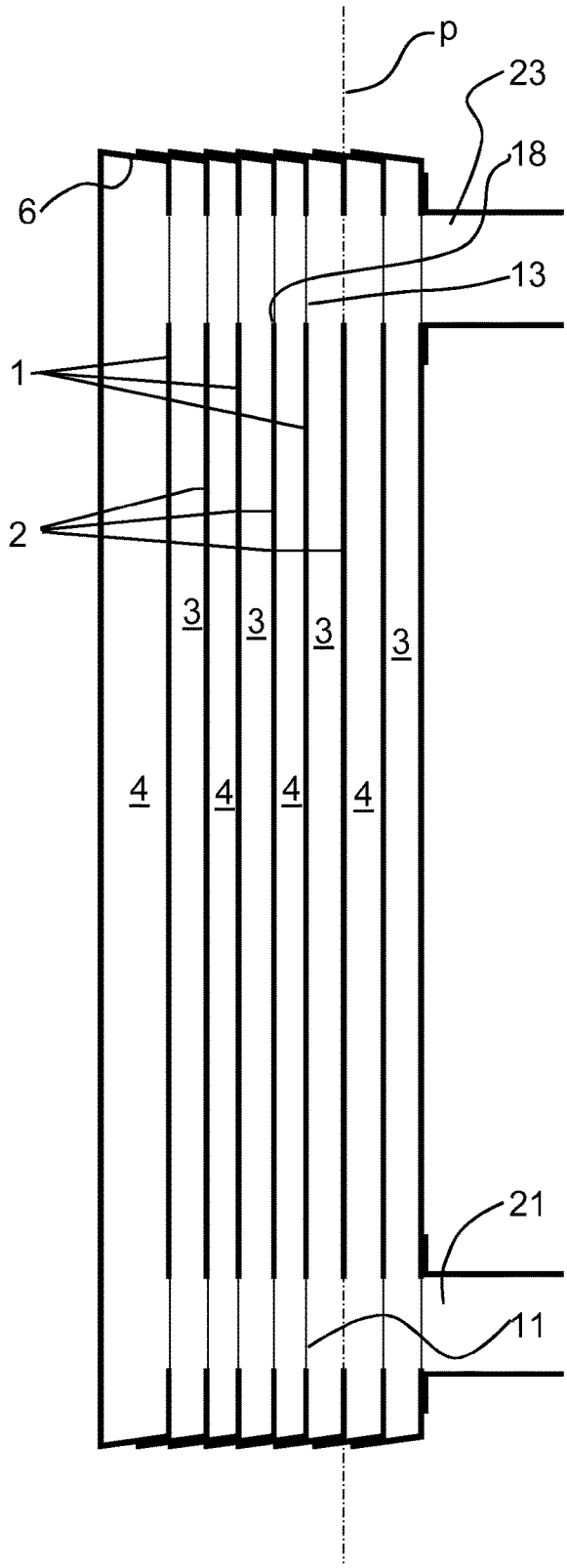
FIG. 2 discloses schematically a longitudinal sectional view along the line II-II in FIG. 1.

FIGS. 1 and 2 disclose a plate heat exchanger comprising a plurality of heat exchanger plates 1, 2. The heat exchanger plates 1, 2 comprise first heat exchanger plates 1 and second heat exchanger plates 2.

The first and second heat exchanger plates 1, 2 are arranged side by side in such in a way that first plate interspaces 3 for a first fluid is formed between each pair of adjacent first and second heat exchanger plates 1, 2, and second plate interspaces 4 for a second fluid between each pair of adjacent second and first heat exchanger plates 2, 1.

The first plate interspaces 3 and the second plate interspaces 4 are provided side by side in an alternating order in the plate heat exchanger, as can be seen in FIG. 2.

The plate heat exchanger is configured to be operated as an evaporator, wherein the first plate interspaces 3 are configured to receive the first fluid to be evaporated therein. The first fluid may be any suitable refrigerant. The second plate interspaces 4 are configured to receive the second fluid for heating the first fluid to be evaporated in the first plate interspaces 3.

The plate heat exchanger may also be reversed, and is then configured to be operated as a condenser, wherein the first fluid, i.e. the refrigerant, is condensed in the first plate interspaces 3, and the second fluid is conveyed through the second plate interspaces 4 for cooling the first fluid conveyed through the first plate interspaces 3.

Each of the first heat exchanger plates 1 and the second heat exchanger plates 2 extends in parallel with an extension plane p.

Figure 3:
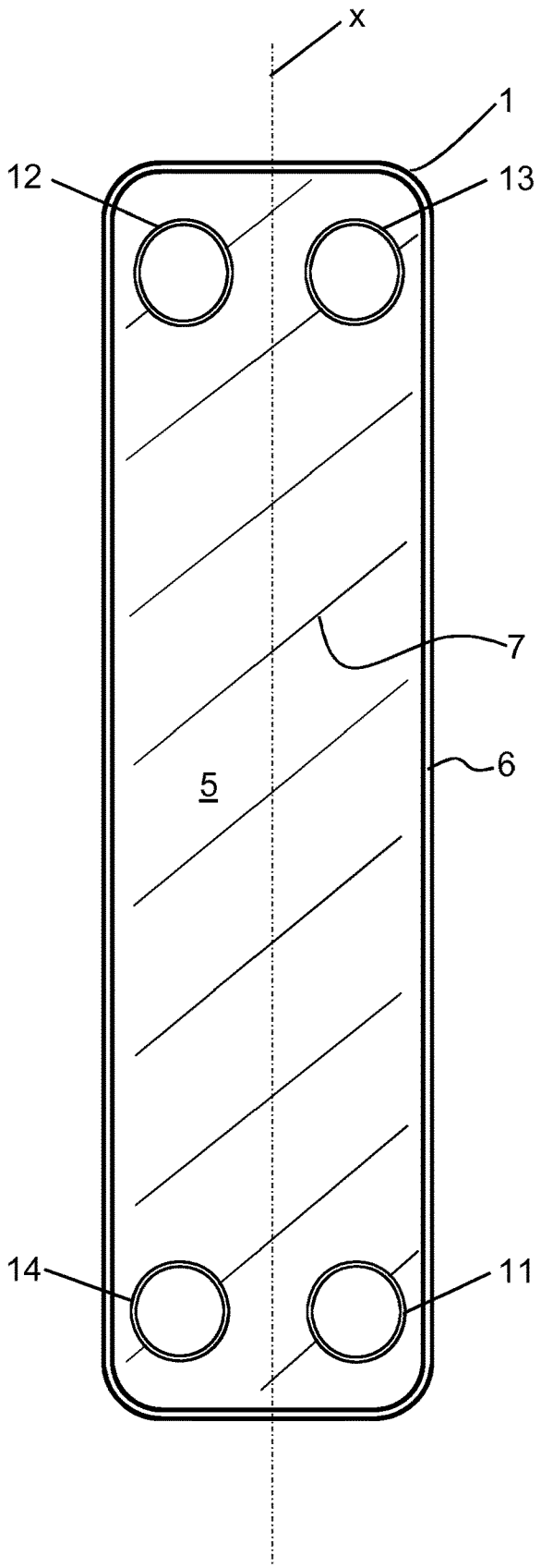
FIG. 3 discloses schematically a plan view of a first heat exchanger plate of the plate heat exchanger in FIG. 1.

Each first and second heat exchanger plate 1, 2 has a heat exchanger area 5, see FIG. 3, extending in parallel with the extension plane p, and an edge area 6 extending around the heat exchanger area 5. The edge area 6 thus surrounds the heat exchanger area 5 and forms a flange which is inclined in relation to the extension plane p, see FIG. 2. The flange of the edge area 6 of one of the heat exchanger plates 1, 2 adjoins, and is joined to a corresponding flange of an edge area 6 of an adjacent one of the heat exchanger plates 1, 2, in a manner known per se.

The heat exchanger area 5 comprises a corrugation 7 of ridges and valleys, which is schematically indicated in FIG. 3. The corrugation 7 may form various patterns, for instance a diagonal pattern, a fishbone pattern, etc. as is known in the art of plate heat exchangers.

Each of the first heat exchanger plates 1 and the second heat exchanger plates 2 also comprises four port holes 11, 12, 13, 14.

Figure 4:
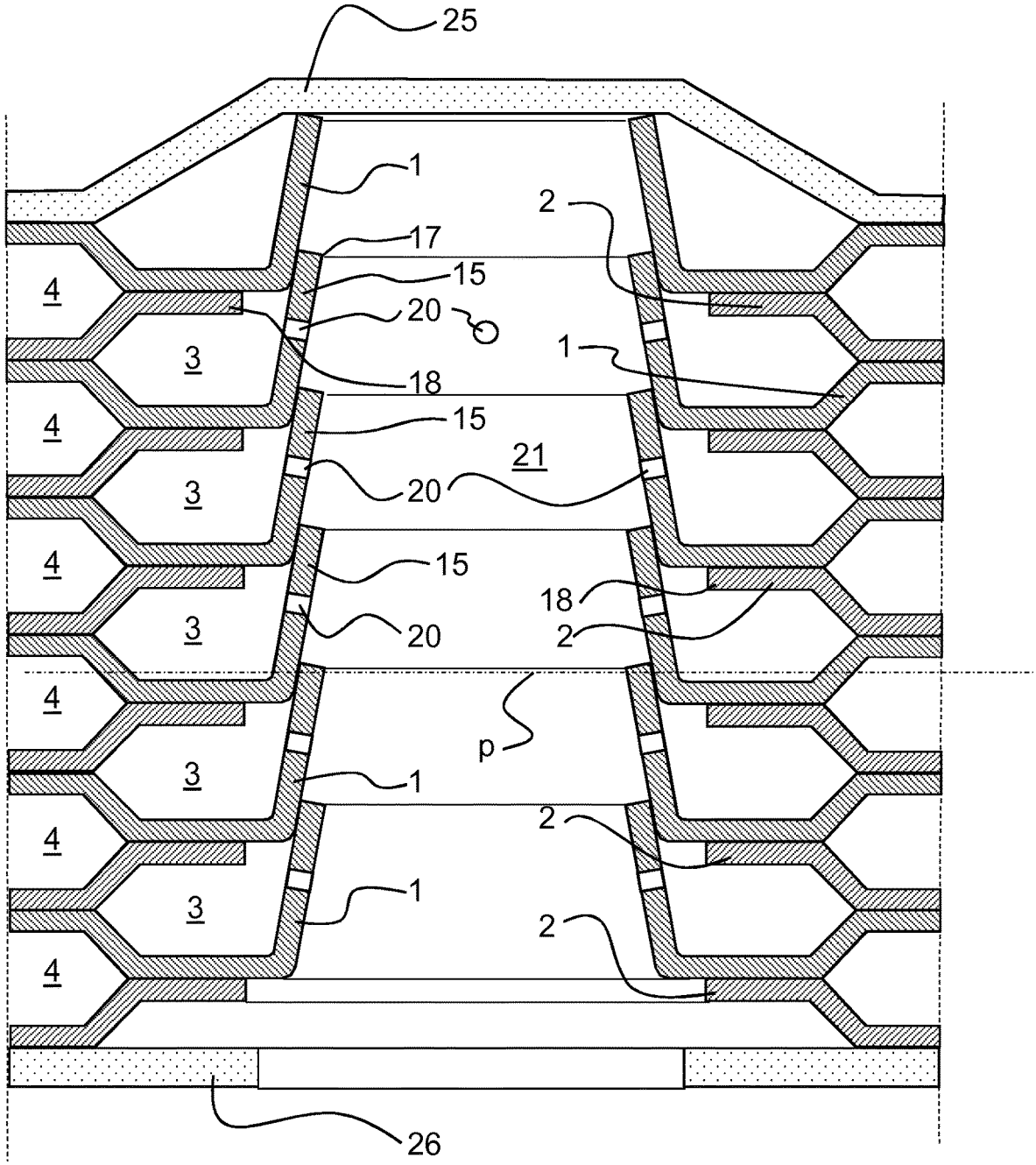
FIG. 4 discloses schematically a sectional view of a first porthole area of the plate heat exchanger in FIG. 1.
Figure 5:
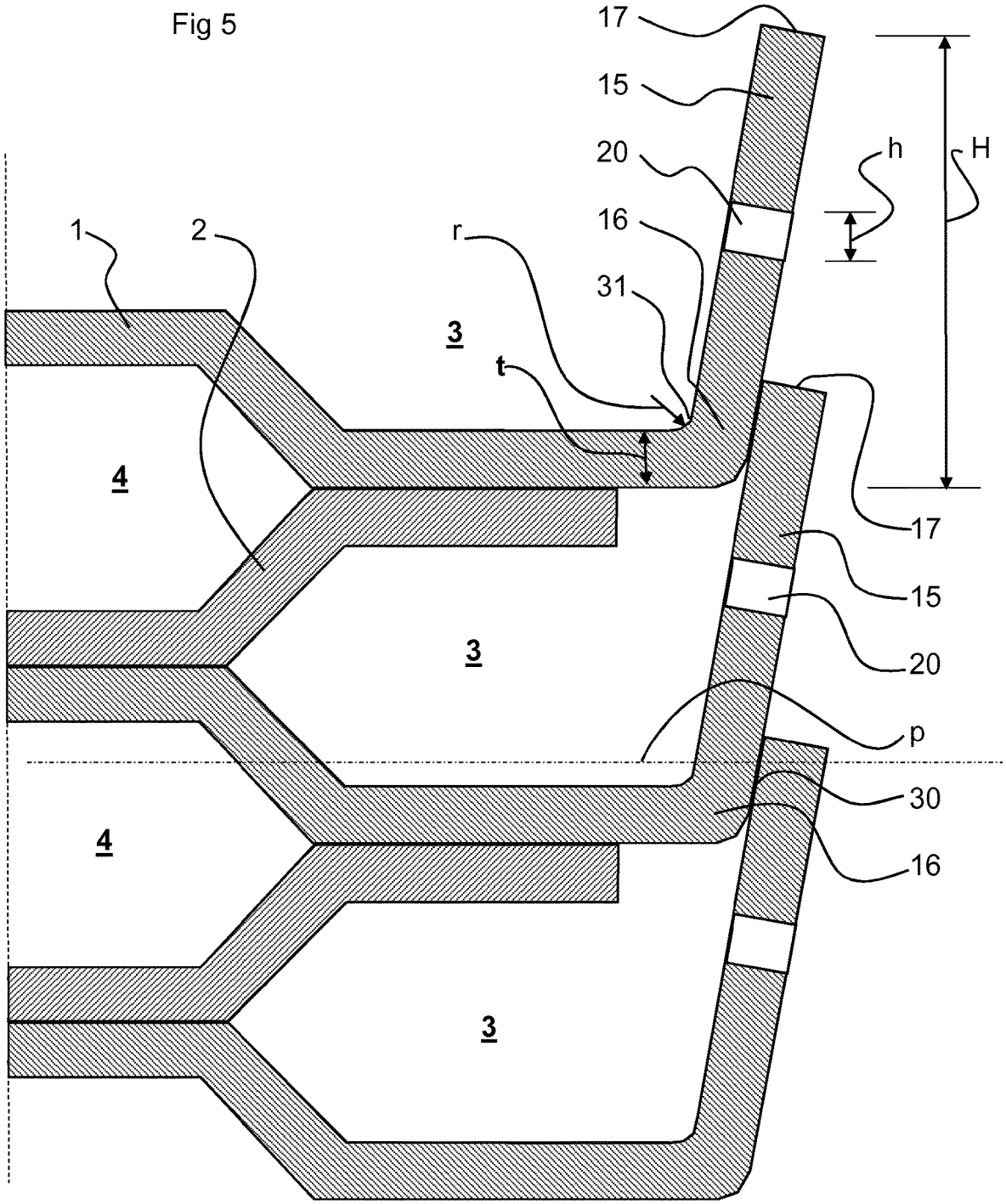
FIG. 5 discloses schematically a sectional view of a part of the first porthole area in FIG. 4.

A first port hole 11 of the port holes 11-14 of the first heat exchanger plates 1 is surrounded by a peripheral rim 15, see FIGS. 4 and 5. The peripheral rim 15 is annular and extends away from the heat exchanger area 5 transversally, or substantially transversally to the extension plane p.

The peripheral rim 15 has a root end 16 and a top end 17. The peripheral rim 15 has a rim height H perpendicular to the extension plane p from the root end 16 to the top end 17, see FIG. 5.

As can be seen in FIGS. 4 and 5, the peripheral rim 15 is tapering or conical, or slightly tapering or conical, and tapers towards the top end, especially from the root end 16 to the top end 17.

The remaining three port holes 12-14 are not provided with such a peripheral rim, but are defined by a porthole edge 18, schematically indicated in FIG. 2 for the portholes 13.

In the embodiments disclosed, the first port hole 11 of the second heat exchanger plates 2 also lacks the peripheral rim. The first port hole 11 of the second heat exchanger plates 2 is defined by a porthole edge 18, see FIGS. 4 and 5.

Each of the first heat exchanger plates 1 also comprises at least one restriction hole 20, which extends through the peripheral rim 15. It should be noted that each peripheral rim 15 may be provided with one or more, for instance two, three, four, five, six or even more restriction holes 20. In one of the first heat exchanger plates 1 shown in FIG. 4, three restriction holes 20 can be seen. The restriction hole 20 has a hole height h perpendicular to the extension plane p, see FIG. 5.

As can be seen in FIG. 4, the uppermost first heat exchanger plate 1 may lack restriction holes 20 since this first heat exchanger plate 1 does not delimit any first plate interspace 3.

However, also this first heat exchanger plate 1 may have one or more restriction holes 20 in order to facilitate the manufacturing by making all first heat exchanger plates 1 identical.

The first heat exchanger plates 1 and the second heat exchanger plates 2 are joined to each other via joints of braze material, such as copper or a copper alloy, between the first and second heat exchanger plates 1, 2. The first and second heat exchanger plates 1, 2 are made of a metal or a metal alloy, such as stainless steel, which extends to the outer surface of the heat exchanger plate 1, 2. The outer surface of the metal or metal alloy has such properties that it adheres to the braze material during the brazing of the plate heat exchanger.

The heat exchanger plates 1, 2 are arranged in such a way that the peripheral rims 15 define an inlet channel 21 extending through the plate heat exchanger. The second port holes 12 of the heat exchanger plates 1, 2 define an outlet channel 22 for the first fluid. The third port hole 13 of the heat exchanger plates 1, 2 define an inlet channel 23 for the second fluid. The fourth port hole 14 of the heat exchanger plates 1, 2 define an outlet channel 24 for the second fluid.

As can be seen in FIG. 4, the plate heat exchanger may also have a first end plate 25, which may form a pressure plate, and a second end plate 26, which may form a frame plate.

The peripheral rim 15 has a convex side, and an opposite concave side. The convex side faces the first plate interspace 3. The concave side faces the inlet channel 21.

At the top end 17, the convex side of the peripheral rim 15 of one of the first heat exchanger plates 1 overlaps the concave side at the root end 16 of the peripheral rim 15 of the adjacent first heat exchanger plate 1, as can be seen in FIGS. 4 and 5. This overlapping forms an overlap joint 30 between peripheral rims 15 of adjacent first heat exchanger plates 1. More precisely, the overlap joint 30 is formed between the convex side and the concave side of adjacent peripheral rims 15.

At the root end 16 of the peripheral rim 15, the convex side forms an annular transition portion 31 between the peripheral rim 15 and the heat exchanger area 5. The annular transition portion 31 is concavely curved and has a radius r of curvature, see FIG. 5.

Each first heat exchanger plate 1 has a thickness t, see FIG. 5. Each second heat exchanger plate 2 may have the same thickness t. The radius r of curvature may vary with the thickness t. Thus, the radius r of curvature may be equal to or less than 3×t.

For instance, the radius r of curvature may be at most 1 mm. Preferably, the radius r of curvature may be at most 0.7 mm, more preferably at most 0.5 mm, most preferably at most 0.3 mm. The radius r of curvature may be at least 0.2 mm.

The restriction hole 20 forms a fluid passage for the first fluid from the inlet channel 21 to the first plate interspaces 3.

The restriction hole 20 has a hole height h perpendicular to the extension plane p, see FIG. 5. The restriction hole 20 may be circular, oval, or may have any other shape, seen from the inlet channel 21. Especially, the restriction hole 20 may have an oval or other elongated shape, wherein the elongated shape extends in parallel to the extension plane p to maximize the distance to the root end 16 and the top end 17.

The hole height h of the restriction hole 20 may be equal to or smaller than 3 mm. Such a restriction hole 20 forms a restriction or throttling of the first fluid to be evaporated, when the first fluid enters the first plate interspaces 3. The restriction or throttling ensures an improved distribution of the first fluid in the first plate interspaces 3. Preferably, the hole height h of the restriction hole 20 is equal to or smaller than 2 mm, and more preferably equal to or smaller than 1 mm.

The hole height h of the restriction hole 20 may be at least 0.3 mm.

The relation h/H, i.e. the relation between the hole height h of the restriction hole 20 and the rim height H of the peripheral rim 15, may be at most 30%. Preferably, the relation may be at most 25%, more preferably at most 20% and most preferably at most 15%.

The restriction hole 20 is premade before the heat exchanger plates 1, 2 are assembled and joined to each other to form the plate heat exchanger.

The restriction hole 20 will remain open during the brazing of the plate heat exchanger, and after the brazing of the plate heat exchanger has been performed. The restriction hole 20 is so located between the root end 16 and the top end 17 of the peripheral rim 15 that the braze material is prevented from reaching the restriction hole 20 when the heat exchanger plates 1, 2 are joined to each other during the brazing.

More specifically, the restriction hole 20 may be centrally located between the root end 16 and the top end 17 of the peripheral rim. The restriction hole 20 may thus be located at the same distance from the root end 16 and the top end 17.

When the plate heat exchanger is to be brazed for joining the heat exchanger plates 1, 2 to each other, the braze material, for instance in the form of foils, is introduced between adjacent first and second heat exchanger plates 1, 2. During the brazing, the braze material is molten and will flow to the joints which will join the heat exchanger plates 1, 2 to each other. The braze material will then be attracted by the overlap joint 30 and the transition portion 31 due to capillary forces. The melted braze material will thus flow towards the overlap joint 30 and the transition portion 31, i.e. away from the restriction hole 20 located between the overlap joint 30 and the transition portion 31.

The plate heat exchanger as defined above may be manufactured by the following manufacturing steps.

The first heat exchanger plates 1 are provided with a peripheral rim 15 around the first porthole 11, wherein the peripheral rim 15 initially extends in parallel with the extension plane p.

The peripheral rim 15 is then bent to extend transversely to the extension plane p from the root end 16 to a top end 17 with a rim height H perpendicular to the extension plane p.

The restriction hole 20 is made through the peripheral rim 15 by any suitable hole-making method, such as drilling, laser beam cutting, electron beam cutting, etc.

It is to be noted that the restriction hole 20 may be made before or after the bending of the peripheral rim 15.

Thereafter, the first and second heat exchanger plates 1, 2 are arranged side by side in an alternating order with braze material, for instance in the form of foils, between adjacent first and second heat exchanger plates 1, 2.

The first heat exchanger plates 1, the second heat exchanger plates 2 and the braze material are the heated to melt the braze material. The melted braze material is attracted by areas where the first and second heat exchanger plates 1, 2 are close to or adjoining each other. After active or passive cooling, the heat exchanger plates 1, 2 are joined to each other via joints of braze material between the first and second heat exchanger plates 1, 2. Thanks to the corrugation 7 of the heat exchanger plates, the first plate interspaces 3 for the first fluid to be evaporated, and the second plate interspaces 4 for the second fluid are formed. Moreover, the peripheral rims 15 together define the inlet channel 21, which extends through the plate heat exchanger. The restriction hole 20 will remain open and form a fluid passage for the first fluid from the inlet channel 21 to the first plate interspaces.

The invention is also applicable to heat exchanger plates and plate heat exchangers having another number of portholes than four, for instance six portholes. The plate heat exchanger may then comprise primary first plate interspaces for a primary first fluid to be evaporated, secondary first plate interspaces for a secondary first fluid to be evaporated, and second plate interspaces for a second fluid to heat, or possibly cool, the primary and secondary first fluids. There are then two inlet channels formed by respective peripheral rims and leading to the primary first plate interspace and the secondary first plate interspaces, respectively. Each second plate interspace is adjacent to a primary first interspace and a secondary first plate interspace.

The invention is not limited to the embodiments disclosed, but may be varied and modified within the scope of the following claims.

The invention claimed is:

1. A heat exchanger plate configured to be arranged between and brazed to two other heat exchanger plates in a plate heat exchanger configured for evaporation of a first fluid, the heat exchanger plate comprising:

- a heat exchanger area extending in parallel with an extension plane of the heat exchanger plate;
- an edge area extending around the heat exchanger area;
- a number of portholes extending through the heat exchanger area;
- a peripheral rim surrounding a first porthole of said number of portholes and extending transversely to the extension plane from a root end to a top end with a rim height H perpendicular to the extension plane, the peripheral rim including an inner surface facing inwardly toward a region surrounded by the peripheral rim and an outer surface facing outwardly away from the region;

at least one restriction hole extending through the peripheral rim to throttle the first fluid passing through the at least one restriction hole, the at least one restriction hole being premade before the heat exchanger plate is arranged between and brazed to the two other heat exchanger plates via joints of braze material so that an entirety of both the inner surface and the outer surface of the peripheral rim from the top end of the peripheral rim to the root of the peripheral rim is a free surface that is free of contact with the two other heat exchanger plates, the at least one restriction hole possessing a hole height h perpendicular to the extension plane, the relation h/H being at most 30%; and the heat exchanger plate possessing a thickness, the peripheral rim forming a transition portion to the heat exchanger area, and the transition portion being concavely curved with a radius of curvature equal to or less than 3 times the thickness of the heat exchanger plate so that the braze material is attracted toward the transition portion due to capillary forces.

2. A heat exchanger plate according to claim 1, wherein the at least one restriction hole is centrally located between the root end and the top end of the peripheral rim.

3. A heat exchanger plate according to claim 1, wherein the hole height of the at least one restriction hole is equal to or smaller than 3 mm.

4. A heat exchanger plate according to claim 1, wherein the heat exchanger plate is made of a metal or a metal alloy extending to the outer surface of the heat exchanger plate.

5. A heat exchanger plate according to claim 1, wherein the radius of curvature is at most 1 mm.

6. A heat exchanger plate according to claim 1, wherein the hole height of the at least one restriction hole is equal to or smaller than 2 mm.

7. A heat exchanger plate according to claim 1, wherein the hole height of the at least one restriction hole is equal to or smaller than 1 mm.

8. A plate heat exchanger for evaporation, the plate heat exchanger comprising:

first heat exchanger plates and second heat exchanger plates, which form first plate interspaces for a first fluid to be evaporated and second plate interspaces for a second fluid;

each of the first heat exchanger plates and each of the second heat exchanger plates extending in parallel with an extension plane and comprising:

a heat exchanger area extending in parallel with the extension plane of the heat exchanger plate, an edge area extending around the heat exchanger area, and a number of portholes extending through the heat exchanger area;

each of the first heat exchanger plates comprising a peripheral rim surrounding a first porthole of said number of portholes and extending transversely to the extension plane from a root end to a top end with a rim height H perpendicular to the extension plane;

each of the first heat exchanger plates comprising at least one restriction hole extending through the peripheral rim and possessing a hole height h perpendicular to the extension plane, the relation h/H being at the most 30%, the first heat exchanger plates and the second heat exchanger plates being joined to each other via joints of braze material between the first and second heat exchanger plates and arranged in such a way that the peripheral rims define an inlet channel extending through the plate heat exchanger;

the at least one restriction hole forming a fluid passage for the first fluid from the inlet channel to the first plate interspaces to throttle the first fluid entering the first plate interspaces;

the at least one restriction hole being premade before the first heat exchanger plates and the second heat exchanger plates are assembled and joined to each other via the joints to form the plate heat exchanger; and each of the first heat exchanger plates possessing a thickness, the peripheral rim forming a transition portion to the heat exchanger area, and the transition portion being concavely curved with a radius of curvature equal to or less than 3 times the thickness so that the braze material is attracted toward the transition portion due to capillary forces.

9. A plate heat exchanger according to claim 8, wherein the at least one restriction hole is so located between the root end and the top end of the rim to prevent the braze material from reaching the restriction hole when the first and second heat exchanger plates are joined to each other, and wherein the at least one restriction hole is centrally located between the root end and the top end of the peripheral rim.

10. A plate heat exchanger according to claim 8, wherein the hole height of the at least one restriction hole is equal to or smaller than 3 mm.

11. A plate heat exchanger according to claim 8, wherein the top end of the peripheral rim of one of the first heat exchanger plates and the root end of the peripheral rim of an adjacent first heat exchanger plate overlap each other and form an overlap joint.

12. A plate heat exchanger according to claim 8, wherein the hole height of the at least one restriction hole is equal to or smaller than 2 mm.

13. A plate heat exchanger according to claim 8, wherein the hole height of the at least one restriction hole is equal to or smaller than 1 mm.

14. A method of making a plate heat exchanger configured for evaporation, comprising first heat exchanger plates and second heat exchanger plates, wherein each of the first and second heat exchanger plates has a number of portholes and wherein a first porthole of said number of portholes of the first heat exchanger plates is surrounded by a peripheral rim, the method comprising:

bending the peripheral rim to extend transversely to an extension plane of the first heat exchanger plate from a root end to a top end with a rim height H perpendicular to the extension plane;

making at least one restriction hole through the peripheral rim before or after the bending of the peripheral rim;

arranging the first and second heat exchanger plates side-by-side with braze material therebetween to permit formation of a first plate interspace for a first fluid to be evaporated and a second plate interspace for a second fluid, the arranging the first and second heat exchanger plates side-by-side with braze material therebetween occurring after the making of the at least one restriction hole and after the bending of the peripheral rim; and heating the first heat exchanger plates, the second heat exchanger plates and the braze material to join the side-by-side heat exchanger plates to each other via joints of braze material between the first and second heat exchanger plates, with the peripheral rims together defining an inlet channel extending through the plate heat exchanger, the at least one restriction hole, which has a hole height h perpendicular to the extension plane, forming a fluid passage for the first fluid from the inlet channel to the first plate interspaces, the relation h/H is at the most 30%, and each of the first heat exchanger plates possessing a thickness, with the peripheral rim forming a transition portion to the heat exchanger area, and the transition portion being concavely curved with a radius of curvature equal to or less than 3 times the thickness so that the braze material is attracted toward the transition portion due to capillary forces.

15. A method according to claim 14, wherein the arranging of the first and second heat exchanger plates side-by-side comprises arranging the first and second heat exchanger plates so that the top end of the peripheral rim of one of the first heat exchanger plates is introduced into the root end of the peripheral rim of an adjacent first heat exchanger plate to permit formation of an overlap joint.

* * * * *